US005495726A

United States Patent [19]

Lee

[11] Patent Number: 5,495,726

[45] Date of Patent: Mar. 5, 1996

[54] MECHANISM FOR COOLING A FRESH FOOD COMPARTMENT OF A REFRIGERATOR

[75] Inventor: Jeoungowan Lee, Incheon, Rep. of Korea

[73] Assignee: Daewoo Electronics Co., Ltd., Seoul, Rep. of Korea

[21] Appl. No.: 311,458

[22] Filed: Sep. 26, 1994

[30] Foreign Application Priority Data

Sep. 24, 1993 [KR] Rep. of Korea ..... 93-19561
Sep. 24, 1993 [KR] Rep. of Korea ..... 93-19564

[51] Int. Cl.[6] ..... F25D 17/08
[52] U.S. Cl. ..... 62/413; 62/419
[58] Field of Search ..... 62/407, 413, 419, 62/426, 440

[56] References Cited

U.S. PATENT DOCUMENTS

| | | | |
|---|---|---|---|
| 2,300,640 | 11/1942 | Bonsall | 62/413 X |
| 3,702,544 | 11/1972 | Grinups | 62/419 X |
| 4,592,209 | 6/1986 | Casanova et al. | 62/255 |
| 5,048,306 | 9/1991 | Wakatsuki et al. | 62/419 |
| 5,056,332 | 10/1991 | Tajima et al. | 62/252 |
| 5,074,126 | 12/1991 | Mahieu | 62/388 |
| 5,177,976 | 1/1993 | Lim et al. | 62/440 X |
| 5,214,936 | 6/1993 | Lim et al. | 62/407 |

*Primary Examiner*—William E. Tapolcai
*Attorney, Agent, or Firm*—Lowe, Price, LeBlanc & Becker

[57] ABSTRACT

Disclosed is a mechanism capable of cooling a fresh food compartment of a refrigerator homogeneously without a separate complicated system or a separate operation of any system. The mechanism has a guide plate by which a part of air passes through a vertical channel and the other part of the air is supplied into the compartment. The air having passed through the vertical channel passes through a side wall channel, and then is exhausted into the compartment through front ports of a front port section disposed at a side wall of the compartment.

9 Claims, 9 Drawing Sheets

MECHANISM FOR COOLING A FRESH FOOD COMPARTMENT OF A REFRIGERATOR

BACKGROUND OF THE INVENTION

1. Field of the Invention

The present invention relates to a refrigerator, and more particularly, to a mechanism (or an apparatus) for cooling a fresh food compartment of a refrigerator three-dimensionally to homogenize the temperature distribution in the fresh food compartment.

2. Prior Art

A general refrigerator is a household appliance having a fresh food compartment and a freezer compartment for cooling or freezing and/or storing foods in a cold temperature.

FIGS. 1 and 2 are an inner front view and a right side sectional view of a conventional household refrigerator, and FIG. 3 is a schematic horizontal sectional view of a fresh food compartment 4 of the refrigerator shown in FIGS. 1 and 2. As shown in FIGS. 1 and 2, a freezer compartment 6 is air communicated with fresh food compartment 4 through a first and second passageways 11 and 12 in an insulation box 2. A flow of air cooled by an evaporator 15 is directly blown into freezer compartment 6 by a fan 13 and another stream of the cooled air is transferred to fresh food compartment 4 through second passageway 12, and then is supplied into fresh food compartment 4 through a supply port 14. The air having been circulated in fresh food compartment 4 as shown in FIG. 3 (in FIG. 3, the arrow denotes the air flow) is sent back to evaporator 15 through first passageway 11 and the air blown into freezer compartment 6 is also circulated through first passageway 11 back to evaporator 15. However, in the refrigerator having the above described air circulation mechanism, the temperature distribution in fresh food compartment 4 is apt to be not homogeneous and thereby food stored at some section in fresh food compartment 4 may be turned rotten or sour, because fresh food compartment 4 has relatively large bulk compared with that of freezer compartment 6 and the temperature in fresh food compartment 4 is higher, usually above zero degree, than that in freezer compartment 6. Accordingly, that fresh food compartment 4 of a refrigerator should be cooled homogeneously has been strongly required.

U.S. Pat. No. 5,056,332 (issued to Tajima et al.) discloses a refrigerator which is capable of uniformly refrigerating goods in the storage chamber, or the fresh food compartment, by uniformly circulating cold air therein and permits easy access to any goods placed in the refrigerator. The refrigerator has a thermal insulation box which is generally rectangular in horizontal cross section and a storage chamber in the thermal insulating box, and includes rotatable and generally round shelves in the storage chamber and cold air passages formed in a region outside the shelves but within the thermal insulating box and communicating with the storage chamber.

Tajima et al. asserted that such round shelves permit efficient utilization of otherwise non-usable dead corners of the storage chamber, because firstly, the round shelves provide excellent cold air feeding mechanism along the corners of the storage chambers, and they may provide extra space for goods by extending deeply into the rear portion of the refrigerator.

However, in Tajima et al. refrigerator, separate systems for installing and rotating the round shelves are required and thereby manufacturing the refrigerator is relatively difficult and costs much. Further, because the round shelves can exhibit its singular function only when it can rotate, the goods in the storage chamber can be put on an area only in the range of the rotational radius of the shelves, and thereby it can be said that the space-utilizing efficiency of the refrigerator is not so high notwithstanding their assertion, and even low especially when the storage chamber is rectangular. Furthermore, because the temperature distribution in the storage chamber is not homogeneous, separate operations such as rotations of the round shelves are required to cool the goods stored in the storage chamber uniformly.

In the meantime, U.S. Pat. No. 5,074,126 (issued to Mahieu) and U.S. Pat. No. 4,592,209 (issued to Cassanova et al.) disclose a mobile refrigerated chamber for food products and a display counter for food products, refrigerated by forced ventilation. The two Patents disclose systems and methods for circulating air in a display or refrigerated chamber by supplying the air through side wall thereinto. However, a plurality of pipes or pipes having a plurality of pores are utilized in the above methods, and thereby they are not proper to be adopted for a household refrigerator. That is because the space-utilizing efficiency is very important and then unhidden separate members such as pipes take an unnegligible space and thereby deteriorate the space-utilizing efficiency. Further, they cause bed effects on the aesthetics of the chamber.

SUMMARY OF THE INVENTION

Accordingly, it is an object of the present invention to provide a mechanism for cooling a fresh food compartment of a refrigerator in which air having passed an evaporator is supplied not only from the rear surface but also from the opposite side surfaces of the fresh food compartment so that the fresh food compartment can be cooled homogeneously without a separate complicated system or a separate operation of any system.

To achieve the above object, the present invention provides a mechanism for cooling a fresh food compartment of a refrigerator comprising:

a guide plate for defining a vertical channel through which an air having passed an evaporator passes and supplying a first part of an air therethrough into the fresh food compartment;

a rear channel section disposed in a side wall of the fresh food compartment to define a side wall channel interconnected to the vertical channel therein so as to make a second part of the air pass therethrough;

a first support plate section for supporting the rear channel section and interconnecting the vertical channel, the side wall channel, and the fresh food compartment and having a member for preventing frost-frozen on an inner surface of the side wall due to the air-flow in the side wall channel; and a front port section assembled at a front of the first support plate section to make the air having passed the side wall channel pass therethrough into the fresh food compartment and to prevent an inverse-flow from the fresh food compartment into the side wall channel.

According to one embodiment of the present invention, the mechanism comprises:

a guide plate disposed at a corner between a side and rear walls of the fresh food compartment, and includes a plurality of first exhaust ports formed thereat, by which and the side and rear walls of the fresh food compartment a vertical channel is defined;

a rear channel section disposed in the side wall of the fresh food compartment including a concave bottom plate having a side wall channel defined therein, a first slit and a second slit formed respectively near the left end and at a middle portion thereof, and a base hook disposed thereon between the first and second slits, and a flange provided at a left outer periphery of the bottom plate;

a front port section including a plurality of second exhaust ports formed thereat, and a first, a second, and a third front hooks disposed respectively near a left end, at a middle portion, and near a right end of an inner surface thereof; and a support plate section disposed between the rear channel section and the front port section to be in close contact with the flange of the rear channel section and including an inflow opening formed near the right end thereof, an exhaust opening formed at a middle portion thereof, a first and second holes formed respectively near a left and a right ends of the exhaust opening, and a heat insulating barrier provided between the inflow opening and the right end of the exhaust opening on the inner surface thereof, the first front hook extending through the first hole into the first slit to be engaged therewith, the second front hook extending through the exhaust opening into the second slit to be engaged therewith, the base hook extending through the exhaust opening to be engaged with the left inner periphery of the exhaust opening, the third front hook extending through the second hole to be engaged therewith so that the support plate section is in close contact with the rear channel section and the front port section is tightly fitted at the support plate section to cover the exhaust opening, whereby an air-flowing path is established by the inflow opening, the side wall channel, the exhaust opening, and the second exhaust ports.

According to another embodiment of the present invention, the mechanism comprises:

a guide plate disposed at a corner between a side and a rear walls of the fresh food compartment, and including a plurality of first exhaust ports formed thereat, by which and a side and a rear walls of the fresh food compartment a vertical channel is defined;

a rear channel section disposed in the side wall of the fresh food compartment including a concave bottom plate having a side wall channel defined therein, a first and a second base hooks disposed respectively at a right and a left ends thereof, and a connector pipe provided at a rear part thereof;

a channel pipe interconnecting the vertical section and the connector pipe;

a first support plate section including a first exhaust opening formed at the middle portion thereof, a first and a second holes formed respectively near a left and a right ends of the exhaust openings, and a heat insulating barrier provided between the channel pipe and the first support plate section;

a second support plate section disposed between the rear channel section and the first support plate section and including a plurality of second exhaust openings formed at the middle portion thereof, and a first and a second slits formed respectively near a left end and a right end of the second exhaust openings; and a front port section including a plurality of second exhaust ports formed thereat, and a first and a second hooks disposed respectively at a left and a right ends of an inner surface thereof, the first front hook extending through the first hole into the first slit to be engaged therewith, the second front hook extending through the second hole into the second slit to be engaged therewith, the first and second base hooks extending respectively through one of the second exhaust openings near the opposite ends of the second support plate to be engaged with the respective left and right inner peripheries thereof, so that the first support plate section, the second support plate section, the rear channel section, and the front port section are tightly assembled with each other, whereby an air-flowing path is established by the channel pipe, the side wall channel, the first and second exhaust openings, and the second exhaust ports.

According to the present invention, an air having passed an evaporator is supplied not only from the rear surface but also from the opposite side surfaces of the fresh food compartment and thereby the fresh food compartment is cooled homogeneously without a separate complicated system or a separate operation of any system.

BRIEF DESCRIPTION OF THE DRAWINGS

The above objects and other advantages of the present invention will become more apparent by describing in detail a preferred embodiment thereof with reference to the attached drawings in which.

DESCRIPTION OF THE PREFERRED EMBODIMENT

Hereinafter, several embodiments of the present invention will be described in detail with reference to the drawings.

Embodiment 1

Figure 1:
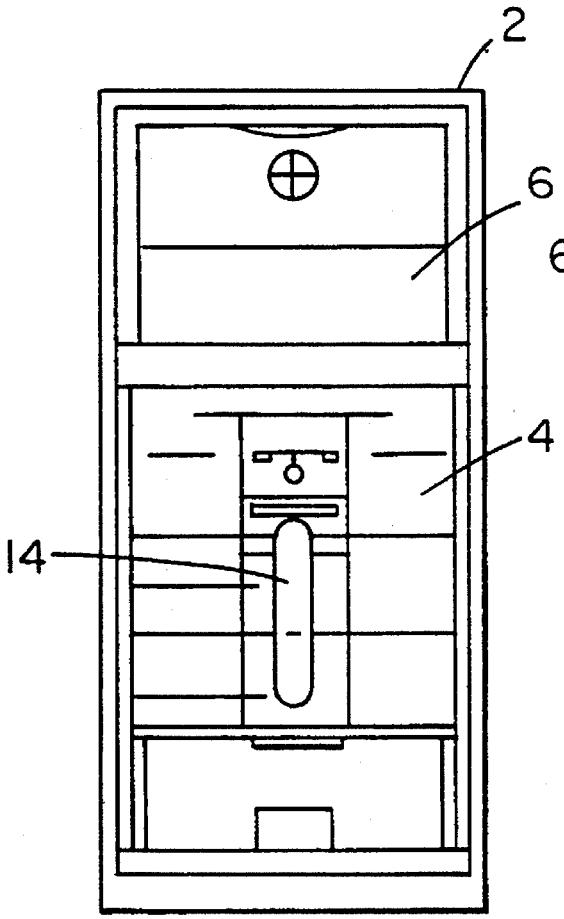
FIG. 1 (PRIOR ART)
FIG. 1 is an inner front view of a conventional household refrigerator.
Figure 2:
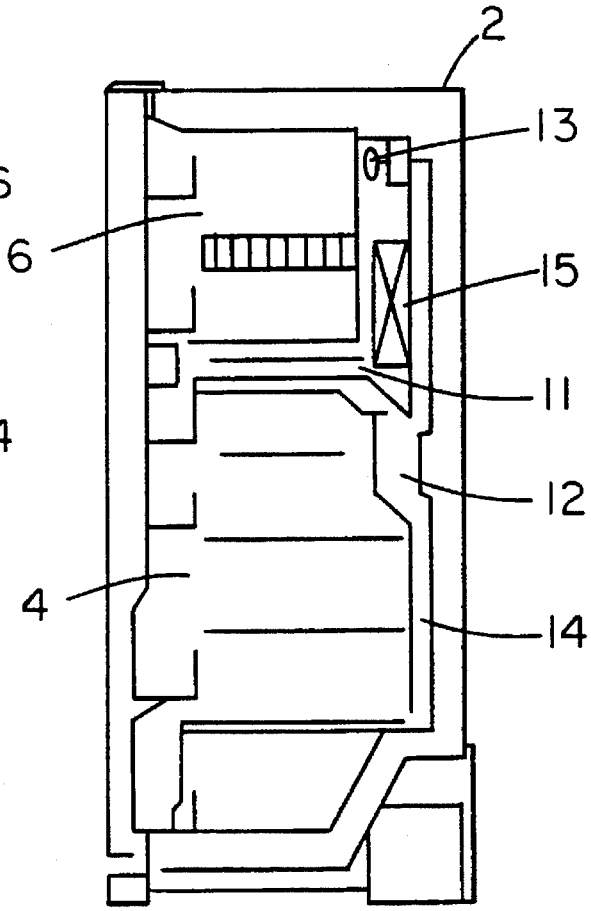
FIG. 2 (PRIOR ART)
FIG. 2 is a right side sectional view of the refrigerator shown in FIG. 1.
Figure 3:
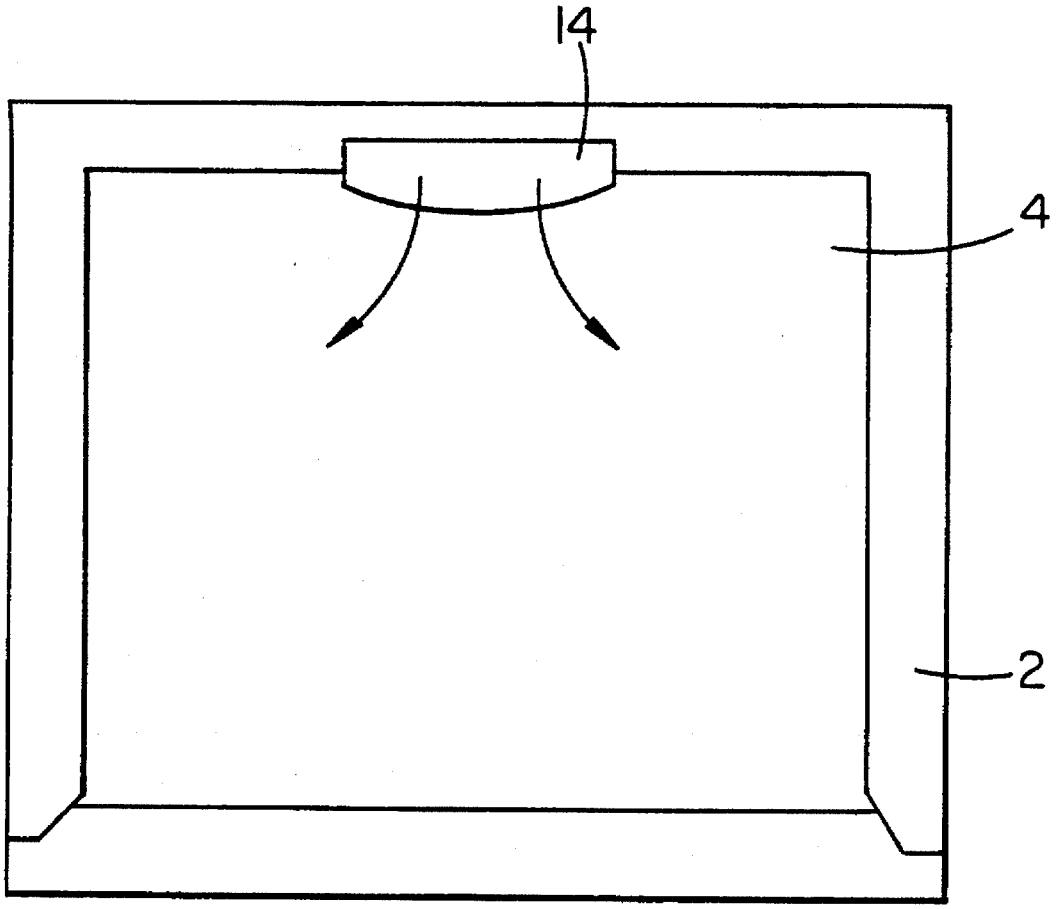
FIG. 3 (PRIOR ART)
FIG. 3 is a schematic horizontal section of a fresh food compartment of the refrigerator shown in FIG. 1, showing the circulation of the air therein.
Figure 4:
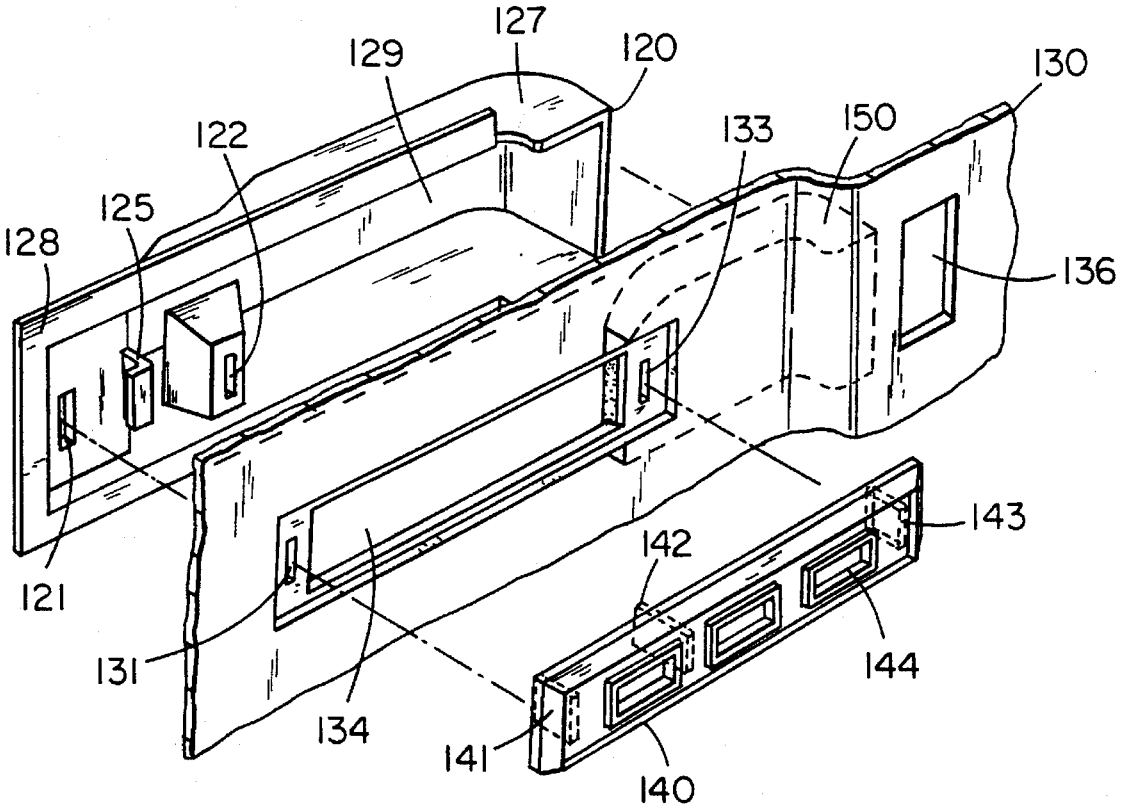
FIG. 4 is an exploded perspective view of a mechanism for cooling a fresh food compartment of a refrigerator in accordance with a first embodiment of the present invention.
Figure 5:
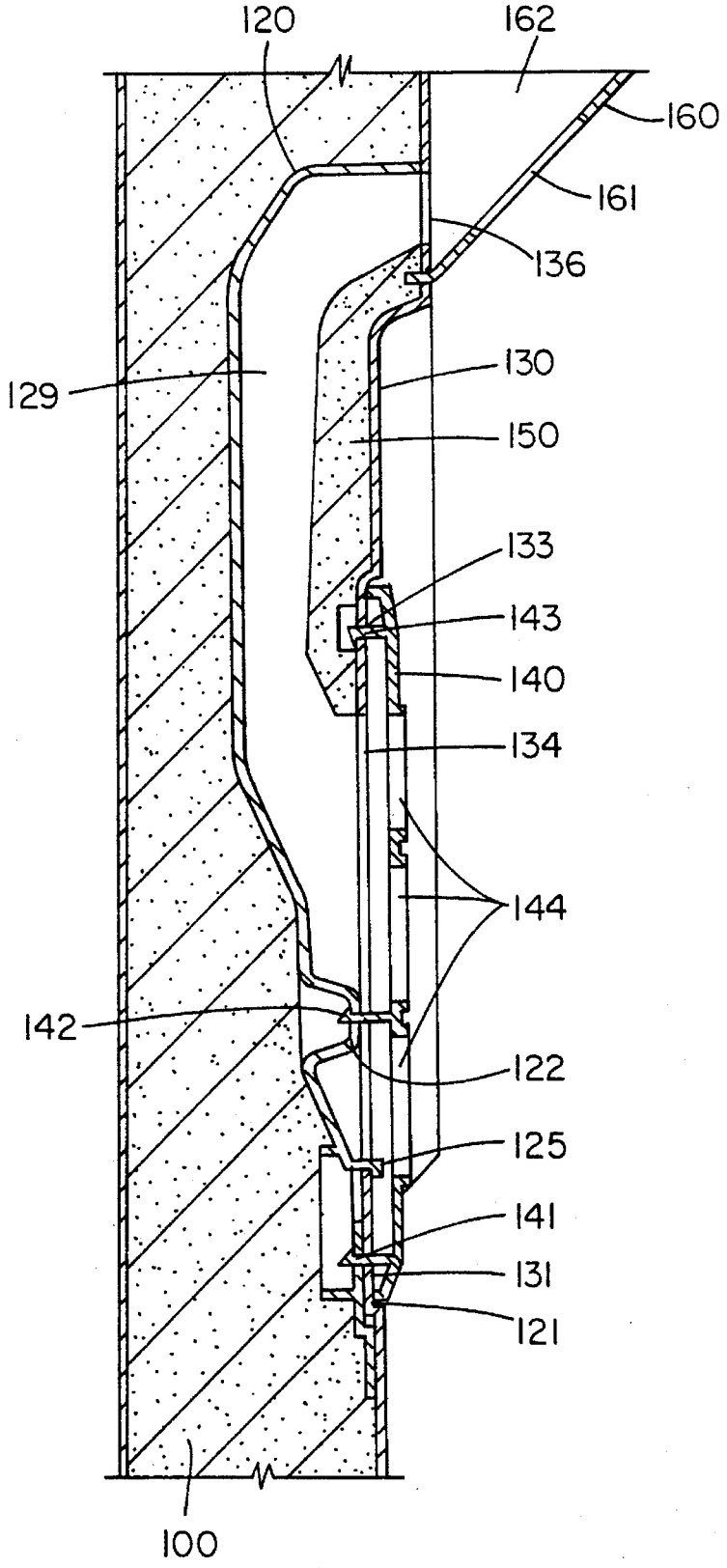
FIG. 5 is a horizontal section of the mechanism shown in FIG. 4.
Figure 6:
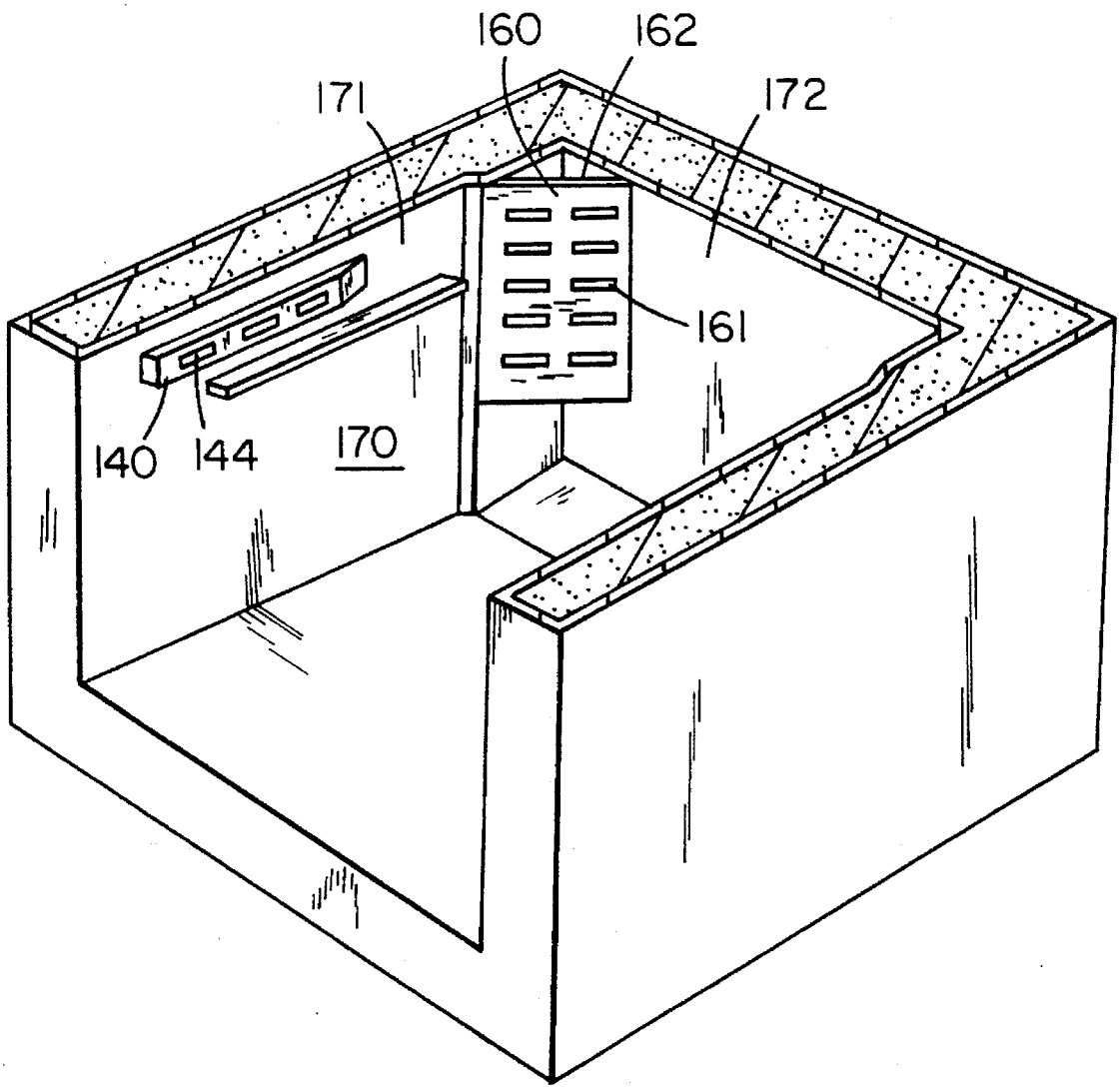
FIG. 6 is a schematic perspective view of a partly-cutaway fresh food compartment which is provided with the mechanism shown in FIG. 4.

FIGS. 4 to 6 show a mechanism for cooling a fresh food compartment of a refrigerator in accordance with a first embodiment of the present invention. Referring to FIGS. 4 to 6, the mechanis includes a rear channel section 120, a front port section 140, a support plate section 130 therebetween, and a guide plate 160 attached on an insulation wall 100.

Rear channel section 120 has a concave bottom plate 127 in which a side wall channel 129 is defined. A first slit 121 and a second slit 122 are formed respectively near the left end and at middle portion of bottom plate 127, and a base hook 125 is disposed between first and second slits 121 and 122 on bottom plate 127. A flange 128 is provided at a left outer rim of bottom plate 127. Flange 128 is in close contact with support plate section 130 when the mechanism is assembled.

Support plate section 130 has an inflow opening 136 formed near right end thereof and an exhaust opening 134 formed at the middle portion thereof. A first and second holes 131 and 133 are formed respectively near the left and right ends of exhaust openings 134. A heat insulating barrier 150 is provided between inflow opening 136 and the right end of exhaust opening 134 on the inner surface of support plate section 130.

Front port section 140 includes a plurality of second exhaust ports 144 formed thereat, the number of which is preferred to be determined in consideration of ornamental effect and is six in the present embodiment, and a first, second, and third front hooks 141, 142, and 143 disposed respectively near the left end, at the middle portion, and near the right end of the inner surface thereof.

Figure 10:
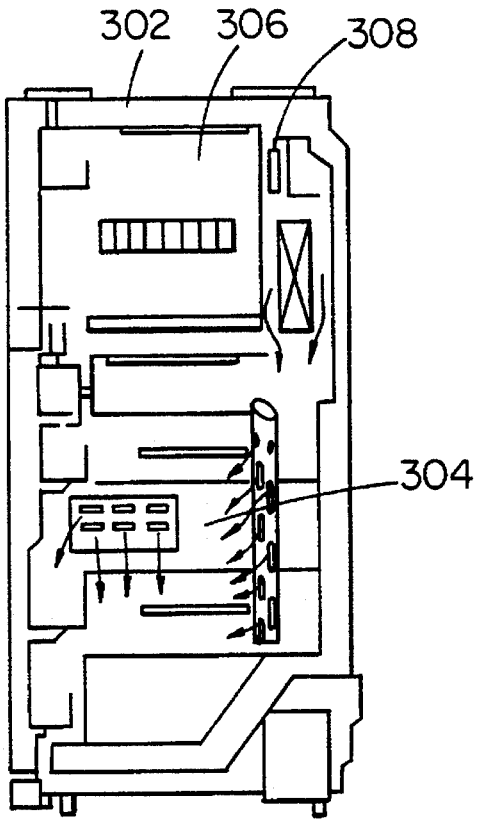

Referring to FIG. 6, guide plate 160 is disposed at a corner between a side and a rear walls 171 and 172 of a fresh food compartment 170, and has a plurality of first exhaust ports 161 formed thereat. A vertical channel 162 is defined by guide plate 160 and side and rear walls 171 and 172 of fresh food compartment 170. Vertical channel 162 is interconnected to an air path accommodating an evaporator as schematically shown in FIG. 10. Fresh food compartment 170 and vertical channel 162 are insulated from each other by guide plate 160, but interconnected to each other only through first exhaust ports 161.

Referring to FIG. 5 showing the mechanism according to the present embodiment wherein rear channel section 120, support plate section 130, and front port section 140 are assembled together, first front hook 141 extends through first hole 131 into first slit 121 to be engaged therewith and second front hook 142 extends through exhaust opening 134 into second slit 122 to be engaged therewith. Base hook 125 extends through exhaust opening 134 and is engaged with the left inner periphery of exhaust opening 134. Third front hook 143 extends through second hole 133 to be engaged therewith. As a result of the above engagements, support plate section 130 is in close contact with rear channel section 120, and front port section 140 is tightly fitted at support plate section 130 to cover exhaust opening 134. Accordingly, an air-flowing path is established by inflow opening 136, side wall channel 129, exhaust opening 134, and second exhaust ports 144.

According to the above described mechanism, the air having passed an evaporator flows through vertical channel 162. Then, a part of the air flows directly into the fresh food compartment through first exhaust ports 161 of guide plate 160, and the other part of the air flows through the air-flowing path established by inflow opening 136, side wall channel 129, exhaust opening 134, and second exhaust ports 144, and then is exhausted into the fresh food compartment. In this case, heat insulating barrier 150 between side wall channel 129 and support section 130 prevents frost on the inner wall of the fresh food compartment by insulating heat-transfer therebetween.

Further, referring again to FIG. 4, it can be seen that front port section 140 is declined toward the fresh food compartment. This inclination prevents the inverse flow of the air from the fresh food compartment into side wall channel 129 which otherwise may happen.

Embodiment 2

Figure 7:
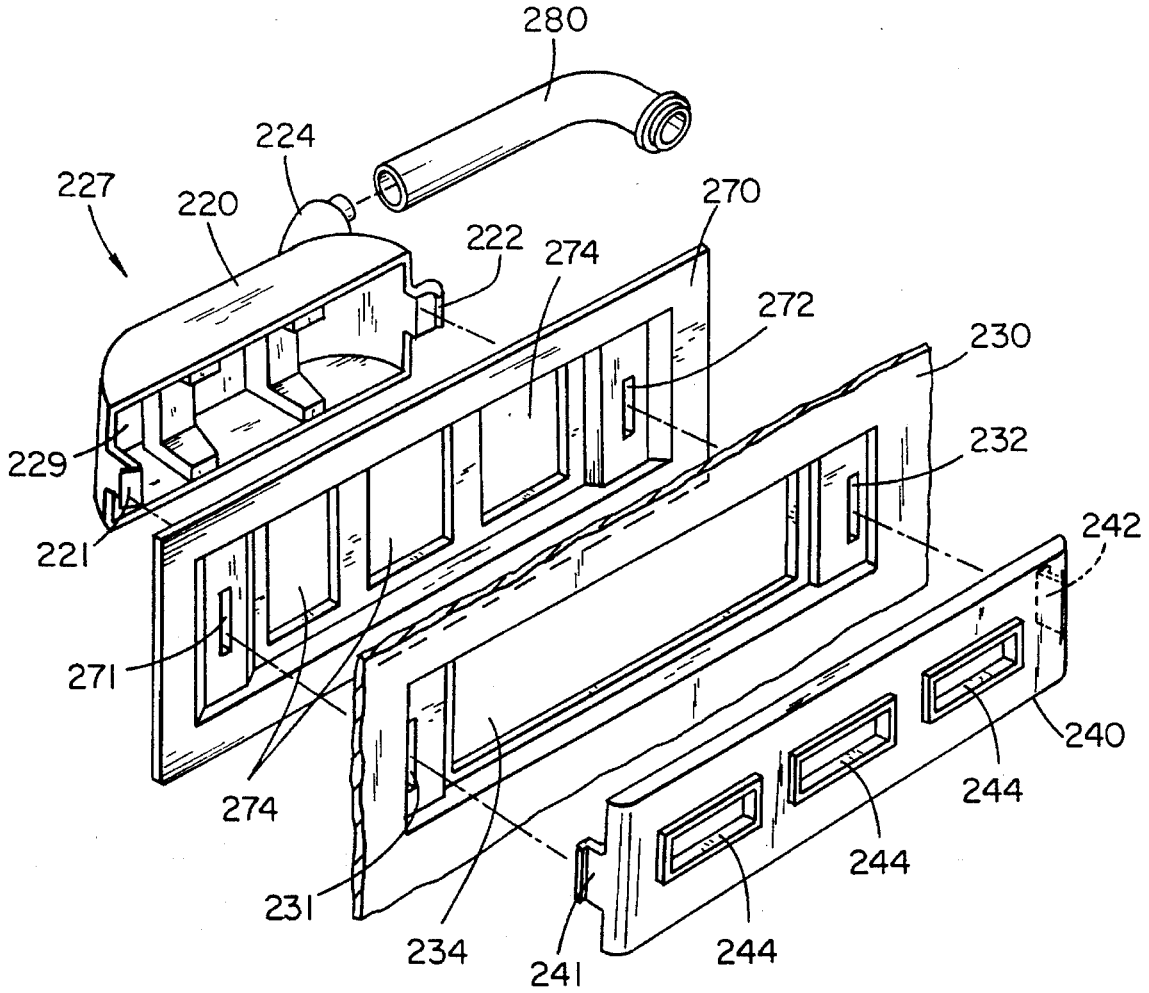
FIG. 7 is an exploded perspective view of a mechanism for cooling a fresh food compartment of a refrigerator in accordance with a second embodiment of the present invention.
Figure 8:
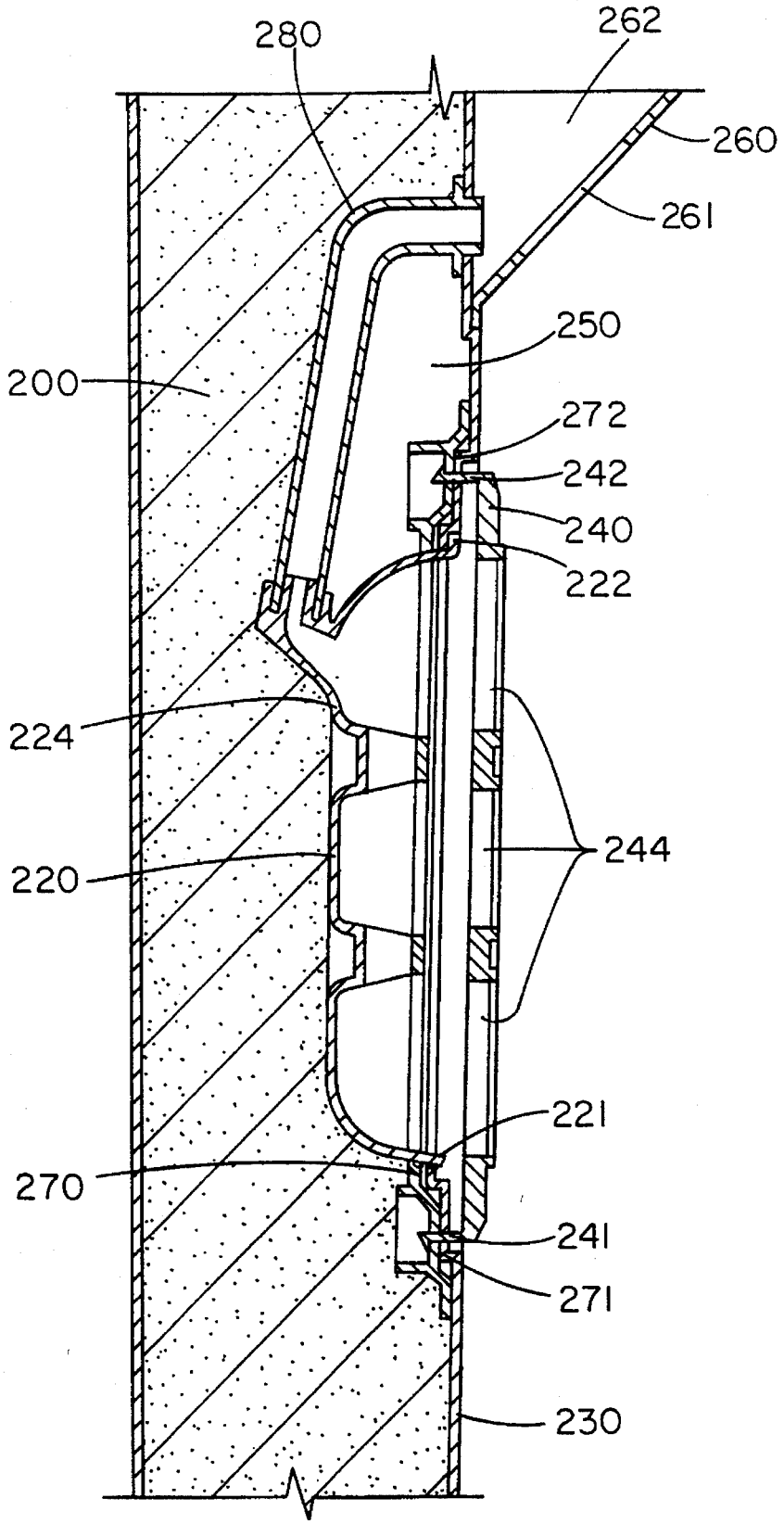
FIG. 8 is a horizontal section of the mechanism shown in FIG. 7.

FIGS. 7 and 8 show a mechanism for cooling a fresh food compartment of a refrigerator in accordance with a second embodiment of the present invention.

Referring to FIGS. 7 and 8, the mechanism includes a front port section 240, a first support plate section 230, a second support plate section 270, a rear channel section 220, a channel pipe 280, and a guide plate 260 attached on an insulation wall 200.

Rear channel section 220 has a concave bottom plate 227 in which a side wall channel 229 is defined. A first and second base hooks 221 and 222 are disposed respectively at the right and left ends of bottom plate 227. A connector pipe 224 is provided at a rear part of bottom plate 227. Connector pipe 224 is interconnected with channel pipe 280 when the mechanism is assembled.

First support plate section 230 has a first exhaust opening 234 formed at the middle portion thereof. A first and second holes 231 and 232 are formed respectively near the left and right ends of exhaust opening 234. A heat insulating barrier 250 is provided between channel pipe 280 and first support plate section 230, as shown in FIG. 8.

A plurality of second exhaust openings 274 are formed at the middle portion of second support plate section 270. A first and a second slits 271 and 272 are formed respectively near the left ends and right end of second support section 270.

Front port section 240 includes a plurality of second exhaust ports 244 formed thereat, and a first and a second hooks 241 and 242 disposed respectively at the left and right ends of the inner surface thereof.

A guide plate 260 is disposed at a corner between a side and rear walls of a fresh food compartment, and has a plurality of first exhaust ports 261 formed thereat, as is in the preceding embodiment. A vertical channel 262 is defined by guide plate 260 and the side and rear walls of the fresh food compartment.

Referring to FIG. 8 showing the mechanism according to the present embodiment when all components of the mechanism are assembled together, first front hook 241 extends through first hole 231 into first slit 271 to be engaged therewith and second front hook 242 extends through second hole 232 into second slit 272 to be engaged therewith. First and second base hooks 221 and 222 extend respectively through one of both second exhaust openings 274 near the opposite ends of second support plate 270 to be engaged with each left and right inner peripheries thereof. One end of channel pipe 280 is interconnected with connector pipe 224 and the other end thereof is connected to vertical channel 262.

As a result of the above engagements, a front port section 240, a first support plate section 230, a second support plate section 270, a rear channel section 220, and a channel pipe 280 are tightly assembled. Accordingly, another air-flowing path is established by channel pipe 280, side wall channel 229, first and second exhaust openings 234 and 274, and second exhaust ports 244.

Further, as is in the preceding embodiment, front port section 240 is declined toward the fresh food compartment and this inclination prevents the inverse flow of the air from the fresh food compartment into side wall channel 229 which otherwise may happen.

In the mechanism according to the present embodiment, the air having passed an evaporator flows through vertical channel 262. Then, a part of the air flows directly into the fresh food compartment through first exhaust ports 261 of guide plate 260, and the other part of the air flows through the air-flowing path established by channel pipe 280, side wall channel 229, first and second exhaust openings 234 and 274, and second exhaust ports 244, and then exhausted into the fresh food compartment. In this case, heat insulating barrier 250 between channel pipe 280 and first support plate section 230 prevents frost on the inner wall of the fresh food compartment by insulating heat-transfer therebetween.

Figure 9:
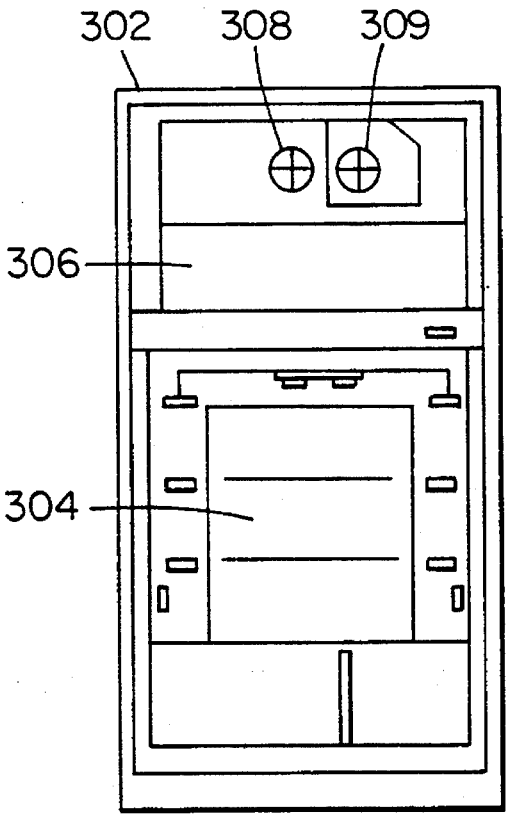
FIGS. 9 and 10 are an inner front view and a side sectional view of a refrigerator equipped with the mechanism shown in FIG. 4.
Figure 11:
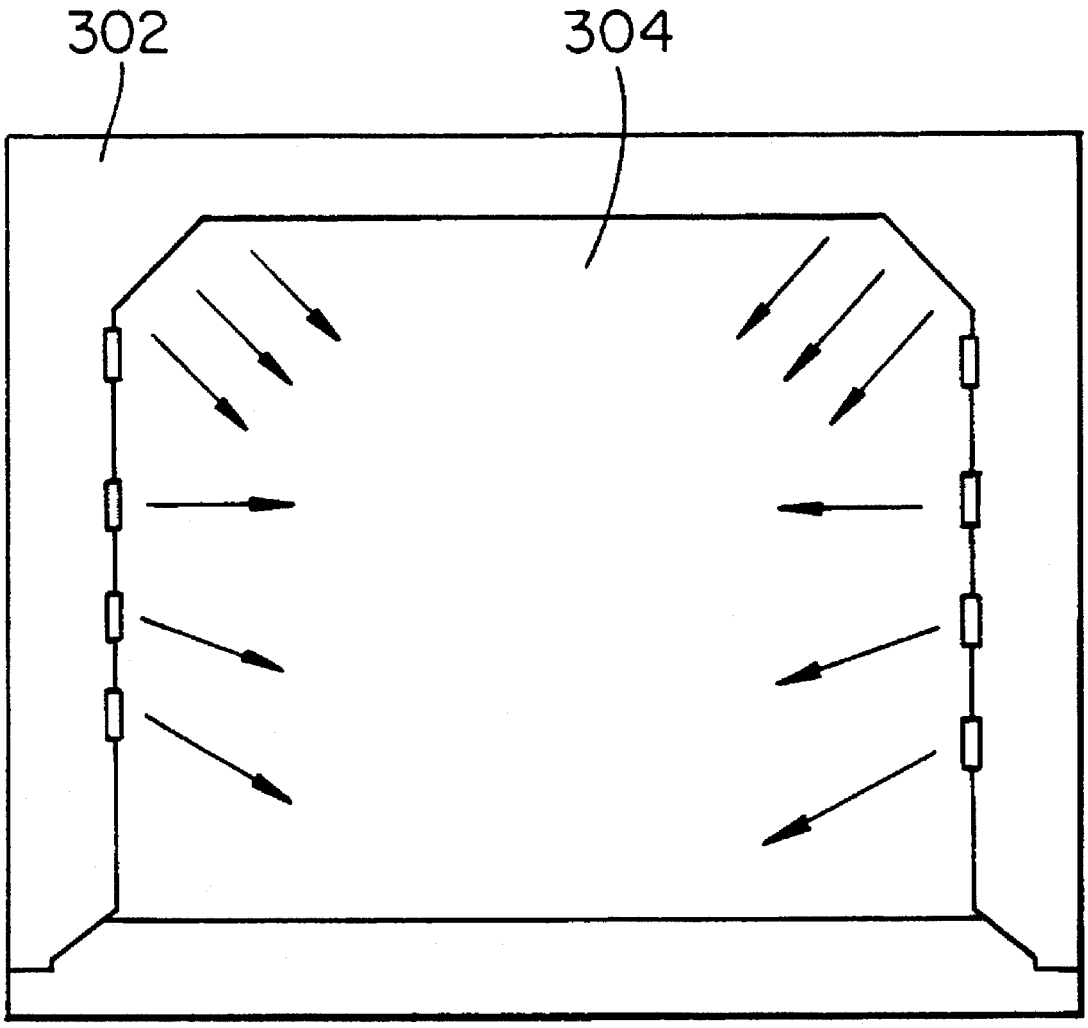
FIG. 11 is a schematic horizontal section of a fresh food compartment of the refrigerator shown in FIG. 4, showing the circulation of the air therein.

FIGS. 9 and 10 are an inner front view and a right side sectional view of a refrieerator equipped with a mechanism of the present invention, and FIG. 11 shows an air circulation in a fresh food compartment 304 of the refrigerator wherein the arrows denote the air flow.

A part of the air flows into a fresh food compartment 304 through first exhaust ports 161 of guide plate 160, and the other part of the air flows into fresh food compartment 304 through the air-flowing path established by inflow opening 136, side wall channel 129, exhaust opening 134, and second exhaust ports 144 by means of a freezing fan 308 and a cooling fan 309. Reference numerals 302 and 306 not described above respectively designate a refrigerator housing and a freezer compartment.

In the mechanism of the present invention, the air exchanges less heat while passing through the air path than while circulating in the fresh food compartment. Therefore, a part of the air introduced into the fresh food compartment after passing through the air path has nearly the same temperature as that of the other part of the air introduced into the fresh food compartment through first exhaust ports 161 without passing through the air path. Accordingly, a fresh food compartment of a refrigerator can be cooled homogeneously without a separate complicated system or a separate operation of any system because air having passed an evaporator is supplied not only from the rear surface but also from the opposite side surfaces of the fresh food compartment as shown in FIG. 11 so that the same cooling force is supplied to every nook and corner of the fresh food compartment directly and rapidly.

Further, goods in a fresh food compartment can be refrigerated or cooled more rapidly and at the same time frost is prevented from being frozen on the inner surface of the fresh food compartment.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A mechanism for cooling a fresh food compartment of a refrigerator comprising:

a guide plate for defining a vertical channel through which an air having passed by an evaporator passes and supplying a first part of an air through the guide plate into the fresh food compartment;

a rear channel section disposed in a side wall of the fresh food compartment, the rear channel section having a side wall channel interconnected to the vertical channel so as to make a second part of the air pass through the side wall channel;

a first support plate section for supporting the rear channel section, the vertical channel and the side wall channel being interconnected through the first support section to the fresh food compartment, the first support plate section having means for preventing frost-frozen on an inner surface of the side wall due to the air-flow in the side wall channel; and a front port section assembled at a front of the first support plate section so as to make the air having passed through the side wall channel pass through the front port section into the fresh food compartment, the front port section preventing an inverse-flow of the air from the fresh food compartment into the side wall channel.

2. A mechanism for cooling a fresh food compartment of a refrigerator as claimed in claim 1, wherein the guide plate is disposed at a corner between side and rear walls of the fresh food compartment, and includes a plurality of first exhaust ports formed at the guide plate, the side and the rear walls of the fresh food compartment and the guide plate together defining the vertical channel.

3. A mechanism for cooling a fresh food compartment of a refrigerator as claimed in claim 1, wherein the rear channel section includes a concave bottom plate having a side wall channel defined in the concave bottom plate, a first slit and a second slit formed respectively near a left end and at a middle portion of the concave bottom plate, and a base hook disposed between the first and second slits, and a flange provided at a left outer periphery of the concave bottom plate.

4. A mechanism for cooling a fresh food compartment of a refrigerator as claimed in claim 3, wherein the first support plate section is assembled at a front of the rear channel section and is in close contact with the flange of the rear channel section, the first support plate section including an inflow opening formed near a right end of the first support plate section, an exhaust opening formed at a middle portion of the first support plate section, first and second holes formed respectively near left and right ends of the exhaust opening, and a heat insulating barrier provided between the inflow opening and a right end of the exhaust opening on an inner surface of the first support plate section.

5. A mechanism for cooling a fresh food compartment of a refrigerator as claimed in claim 4, wherein the front port section is declined toward the fresh food compartment so as to prevent an inverse-flow of the air from the fresh food compartment into the side wall channel, the front port section including a plurality of second exhaust ports formed at the front port section, and first, second, and third front hooks disposed respectively near a left end, at a middle portion, and near a right end of an inner surface of the front port section.

6. A mechanism for cooling a fresh food compartment of a refrigerator as claimed in claim 5, wherein the first front hook extends through the first hole into the first slit and being engaged in the first slit, the second front hook extending through the exhaust opening into the second slit and being engaged in the second slit, the base hook extending through the exhaust opening and being engaged with a left inner periphery of the exhaust opening, and the third front hook extending through the second hole and being engaged in the second hole so that the first support plate section is in close contact with the rear channel section and the front port section is tightly fitted at the first support plate section to cover the exhaust opening, whereby an air-flowing path is established by the inflow opening, the side wall channel, the exhaust opening, and the second exhaust ports.

7. A mechanism for cooling a fresh food compartment of a refrigerator as claimed in claim 1, said mechanism further comprising:

a second support plate section assembled between the rear channel section and the first support plate section, the second support plate section supporting the rear channel section, the vertical channel and the side wall channel being interconnected through the second support plate section to the fresh food compartment; and a channel pipe for interconnecting the vertical channel and the side wall channel to each other.

8. A mechanism for cooling a fresh food compartment of a refrigerator comprising:

a guide plate disposed at a corner between a side and a rear walls of the fresh food compartment, the guide plate including a plurality of first exhaust ports formed at the guide plate, the side and rear walls of the fresh food compartment and the guide plate together defining a vertical channel;

a rear channel section disposed in the side wall of the fresh food compartment, the rear channel section including a concave bottom plate having a side wall channel defined in the concave bottom plate, a first slit and a second slit formed respectively near a left end and at a middle portion of the concave bottom plate, and a base hook disposed between the first and second slits, and a flange provided at a left outer periphery of the concave bottom plate;

a front port section including a plurality of second exhaust ports formed at the front port section, and first, second, and third front hooks disposed respectively near a left end, at a middle portion, and near a right end of an inner surface of the front port section; and a support plate section disposed between the rear channel section and the front port section and being in close contact with the flange of the rear channel section, the support plate section including an inflow opening formed near a right end of the support plate section, an exhaust opening formed at a middle portion of the support plate section, first and second holes formed respectively near left and right ends of the exhaust opening, and a heat insulating barrier provided between the inflow opening and a right end of the exhaust opening on an inner surface of the support plate section, the first front hook extending through the first hole into the first slit and being engaged in the first slit, the second front hook extending through the exhaust opening into the second slit and being engaged in the second slit, the base hook extending through the exhaust opening and being engaged with a left inner periphery of the exhaust opening, and the third front hook extending through the second hole and being engaged in the second hole so that the support plate section is in close contact with the rear channel section and the front port section is tightly fitted at the support plate section to cover the exhaust opening, whereby an air-flowing path is established by the inflow opening, the side wall channel, the exhaust opening, and the second exhaust ports.

9. A mechanism for cooling a fresh food compartment of a refrigerator comprising:

a guide plate disposed at a corner between side and rear walls of the fresh food compartment, the guide plate including a plurality of first exhaust ports formed at the guide plate, the side and rear walls of the fresh food compartment and the guide plate together defining a vertical channel;

a rear channel section disposed in a side wall of the fresh food compartment, the rear channel section including a concave bottom plate having a side wall channel defined in the concave bottom plate, first and second base hooks disposed respectively at right and left ends of the concave bottom plate, and a connector pipe provided at a rear part of the concave bottom plate;

a channel pipe interconnecting the vertical channel and the connector pipe to each other;

a first support plate section including a first exhaust opening formed at a middle portion of the first support plate section, first and second holes formed respectively near left and right ends of the exhaust openings, and a heat insulating barrier provided between the channel pipe and the first support plate section;

a second support plate section disposed between the rear channel section and the first support plate section and including a plurality of second exhaust openings formed at a middle portion of the second support plate section, and first and second slits formed respectively near a left end and a right end of the second support plate section; and a front port section including a plurality of second exhaust ports formed at the front port section, and first and second hooks disposed respectively at left and right ends of an inner surface of the front port section, the first front hook extending through the first hold into the first slit and being engaged in the first slit, the second front hook extending through the second hole into the second slit and being engaged in the second slit, the first and the second base hooks extending respectively through the second exhaust openings near opposite ends of the second support plate and being engaged respectively with left and right inner peripheries of the second exhaust openings, so that the first support plate section, the second support plate section, the rear channel section, and the front port section are tightly assembled with each other, whereby an air-flowing path is established by the channel pipe, the side wall channel, the first and the second exhaust openings, and the second exhaust ports.

* * * * *